US009692117B2

(12) United States Patent
Iwanaka

(10) Patent No.: US 9,692,117 B2
(45) Date of Patent: Jun. 27, 2017

(54) ANTENNA

(71) Applicant: NEC Corporation, Tokyo (JP)

(72) Inventor: Daisuke Iwanaka, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 14/760,968

(22) PCT Filed: Dec. 3, 2013

(86) PCT No.: PCT/JP2013/007074

§ 371 (c)(1),
(2) Date: Jul. 14, 2015

(87) PCT Pub. No.: WO2014/111996

PCT Pub. Date: Jul. 24, 2014

(65) Prior Publication Data

US 2015/0349415 A1 Dec. 3, 2015

(30) Foreign Application Priority Data

Jan. 21, 2013 (JP) ..... 2013-008172

(51) Int. Cl.
*H01Q 13/00* (2006.01)
*H01Q 1/50* (2006.01)
(Continued)

(52) U.S. Cl.
CPC ..... *H01Q 1/50* (2013.01); *H01Q 1/36* (2013.01); *H01Q 13/02* (2013.01);
(Continued)

(58) Field of Classification Search
CPC .. H01Q 21/0006; H01Q 21/0087; H01Q 1/36; H01Q 1/50; H01Q 13/02; H01Q 21/064
(Continued)

(56) References Cited

U.S. PATENT DOCUMENTS 4,783,663 A 11/1988 Rammos et al.
6,137,450 A * 10/2000 Bhattacharyya ..... H01Q 13/02 343/776

(Continued)

FOREIGN PATENT DOCUMENTS

CN 1885616 A 12/2006
CN 102064380 A 5/2011

(Continued)

OTHER PUBLICATIONS

International Search Report corresponding to PCT/JP2013/007074 mailed on Feb. 25, 2014 (one page).

(Continued)

*Primary Examiner* — Linh Nguyen
(74) *Attorney, Agent, or Firm* — Wilmer Cutler Pickering Hale and Dorr LLP

(57) ABSTRACT

An antenna includes an antenna layer, a coupling layer, and a feeder circuit layer. The antenna layer includes antennas elements. First and second antenna elements are arranged in such a manner that the centers thereof are aligned in a first direction. A third antenna element is arranged in such a manner that the third antenna element is separated from the first antenna element in a second direction and centers of the antenna elements are not aligned in the second direction. A waveguide is formed in the coupling layer.

8 Claims, 7 Drawing Sheets

(51) Int. Cl.
*H01Q 13/02* (2006.01)
*H01Q 1/36* (2006.01)
*H01Q 21/00* (2006.01)
*H01Q 21/06* (2006.01)

(52) U.S. Cl.
CPC ..... *H01Q 21/0006* (2013.01); *H01Q 21/0087* (2013.01); *H01Q 21/064* (2013.01)

(58) Field of Classification Search
USPC ..... 343/772, 756, 776, 786, 853
See application file for complete search history.

(56) References Cited

U.S. PATENT DOCUMENTS 9,136,605 B2 * 9/2015 Abe ..... H01Q 13/02
2004/0080463 A1 * 4/2004 Jeong ..... H01Q 1/523 343/770
2006/0158382 A1 7/2006 Nagai
2009/0066598 A1 3/2009 Malstrom et al.
2009/0184881 A1 * 7/2009 Bullock ..... H01Q 1/288 343/873
2010/0066631 A1 * 3/2010 Puzella ..... H01Q 1/02 343/853
2010/0079345 A1 * 4/2010 Takei ..... H01Q 21/061 343/702
2012/0092224 A1 * 4/2012 Sauleau ..... H01Q 3/18 343/771
2013/0120205 A1 * 5/2013 Thomson ..... H01Q 21/0075 343/776
2014/0145893 A1 * 5/2014 Park ..... H01Q 13/02 343/756
2014/0254979 A1 * 9/2014 Zhang ..... H01P 11/002 385/14
2015/0303586 A1 * 10/2015 Hafenrichter ..... H01Q 1/40 343/873
2015/0325925 A1 * 11/2015 Kamgaing ..... H01Q 21/0006 343/893
2016/0072190 A1 * 3/2016 Merk ..... H01Q 1/50 343/776

FOREIGN PATENT DOCUMENTS

CN 202373697 U 8/2012
JP 62-58706 3/1987
JP 08-204428 A 8/1996
JP 3718527 B2 11/2005
JP 2006-203554 A 8/2006
RU 2365000 C1 8/2009
WO WO-89/09501 A1 10/1989
WO WO-2012/169709 A1 12/2012

OTHER PUBLICATIONS

Russian Office Action issued by the Russia Patent Office for Application No. 2015135368/(054212) dated Aug. 3, 2016 (12 pages).
Chinese Office Action issued by the State Intellectual Property Office of The People's Republic of China for Application No. 201380071056 dated Oct. 18, 2016 (14 pages).
Extended European Search Report issued by the European Patent Office for Application No. 13871857.2 dated Aug. 30, 2016 (8 pages).

* cited by examiner

ANTENNA

CROSS-REFERENCE TO RELATED APPLICATIONS

This application is a national stage application of International Application No. PCT/JP2013/007074 entitled "Antenna" filed on Dec. 3, 2013, which claims priority to Japanese Application No. 2013-008172 filed on Jan. 21, 2013, the disclosures of which are hereby incorporated by reference in their entirety.

TECHNICAL FIELD

The present invention relates to an antenna.

BACKGROUND ART

Side-lobe characteristics which are required for antennas used in radio systems, such as point-to-point, are specified in international standards, and it is necessary to suppress the side lobe level to be lower than a predetermined level. Typical international standards are ETSI (European Telecommunications Standards Institute) standards.

A parabola antenna is generally used as an antenna for point-to-point communication. However, when the parabola antenna satisfies the side-lobe standards, the thickness of the antenna increases, which results in an increase in the size of the entire apparatus. For this reason, a planar antenna is desired.

In a millimeter wave band, a planar antenna including a waveguide with a transmission loss lower than that of a microstrip line is used. As a configuration of such a planar antenna, a configuration in which horn antennas are arranged in an array is known (Patent Literature 1). Patent Literature 1 proposes a planar antenna in which horn antennas are arranged in a square lattice. This antenna is characterized by including a box horn at which each horn antenna has a step-like change in shape.

CITATION LIST

Patent Literature

[Patent Literature 1] Japanese Patent No. 3718527

SUMMARY OF INVENTION

Technical Problem

In general, when the distance between antenna elements is longer than one wavelength of a radiated wave, a grating lobe is generated. This results in significant deterioration of the side lobe level. In order to suppress side lobes generated in radio wave radiation characteristics, it is necessary to arrange horn antennas with as high a density as possible. Accordingly, the structure of the horn antennas and the structure of waveguides for guiding radio waves to the horn antennas are miniaturized. As a result, it is difficult to prepare the planar antenna having a miniaturized structure. Even if the planar antenna can be prepared, a cost increase is unavoidable.

The present invention has been made in view of the above-mentioned circumstances, and an object of the present invention is to provide an antenna having excellent side-lobe suppression characteristics.

Solution to Problem

An antenna according to an exemplary aspect of the present invention includes: a feeder circuit layer in which a waveguide entrance and a first waveguide through which radio waves propagate are formed; an antenna layer in which a plurality of antenna elements are formed; and a coupling layer that is formed between the feeder circuit layer and the antenna layer and couples the first waveguide to the plurality of antenna elements with a waveguide. The plurality of antenna elements include a first antenna element, a second antenna element, and a third antenna element, the second and third antenna elements being adjacent to the first antenna element. The first and second antenna elements are arranged in such a manner that centers of the first and second antenna elements are aligned in a first direction parallel to a principal surface of the antenna layer. The third antenna element is arranged in such a manner that the third antenna element is separated from the first antenna element in a second direction and centers of the first and third antenna elements are not aligned in the second direction, the second direction being parallel to the principal surface of the antenna layer and perpendicular to the first direction.

Advantageous Effects of Invention

According to the present invention, it is possible to provide an antenna having excellent side-lobe suppression characteristics.

DESCRIPTION OF EMBODIMENTS

Figure 1:
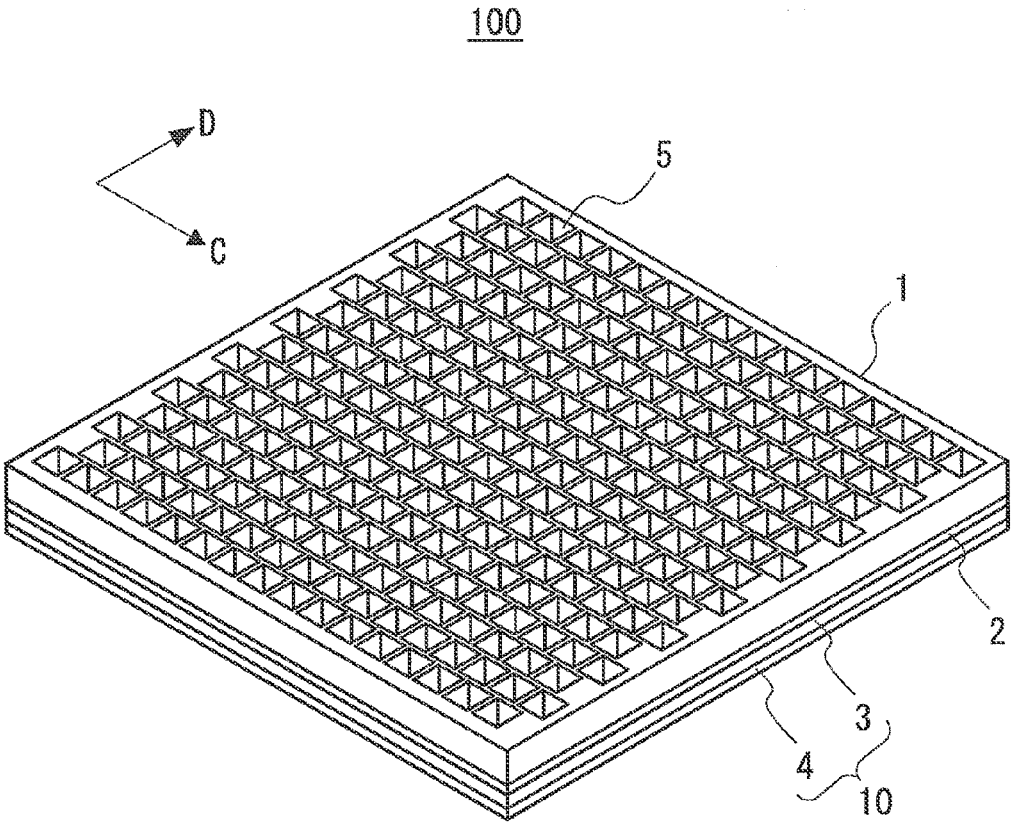
FIG. 1 is a perspective view schematically showing a configuration of an antenna 100.

Exemplary embodiments of the present invention will be described below with reference to the drawings. In the drawings, the same elements are denoted by the same reference numerals, and thus a repeated description is omitted as needed.

First Exemplary Embodiment

First, an antenna 100 according to an exemplary embodiment will be described. FIG. 1 is a perspective view schematically showing the configuration of the antenna 100. The antenna 100 includes an antenna layer 1, a coupling layer 2, a waveguide layer 3, and a bottom layer 4. The antenna layer 1, the coupling layer 2, the waveguide layer 3, and the bottom layer 4 are each formed of, for example, a metal. The waveguide layer 3 and the bottom layer 4 constitute a feeder circuit layer 10.

Figure 2A:
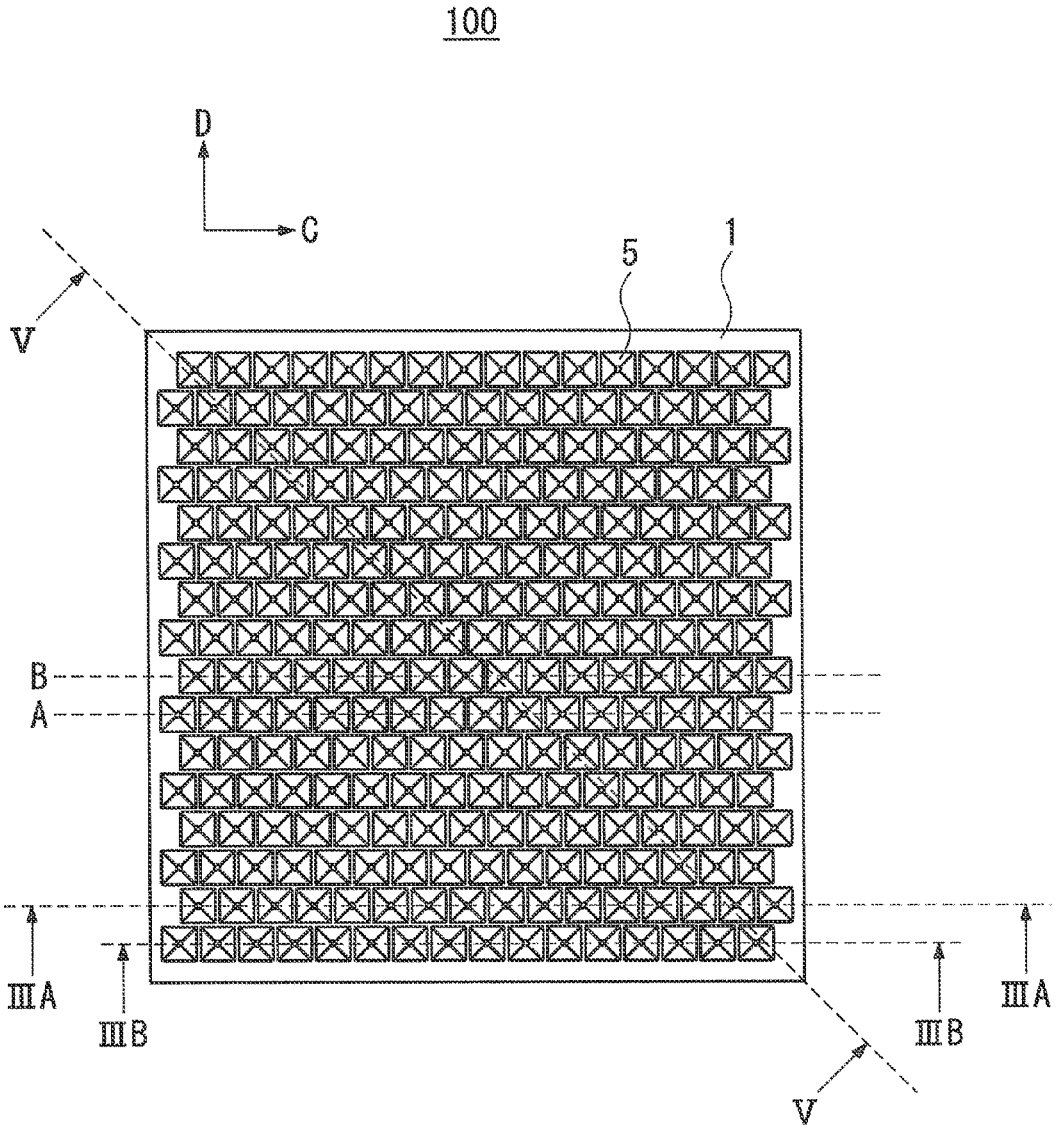
FIG. 2A is a top view schematically showing the configuration of the antenna 100.

FIG. 2A is a top view schematically showing the configuration of the antenna 100. In the antenna layer 1, horn antennas 5 each having a quadrangular pyramid shape are arranged in a staggered manner. Hereinafter, the horn antennas are also referred to simply as antenna elements. The horn antennas in adjacent rows are each arranged with an offset. In this exemplary embodiment, the horn antennas 5 arranged in a row B shown in FIG. 2A are offset in a direction C (also referred to as a first direction) relative to the horn antennas 5 arranged in a row A shown in FIG. 2A. Further, since the horn antennas 5 are arranged in a staggered manner, the center of each horn antenna 5 in the row A is at the same distance from the center between the two horn antennas 5 in the row B that is adjacent in a direction D to the row A.

Note that the direction C is a direction parallel to the principal surface of the antenna layer 1 and the direction D (also referred to as a second direction) is a direction that is parallel to the principal surface of the antennal layer 1 and perpendicular to the direction C.

Figure 2B:
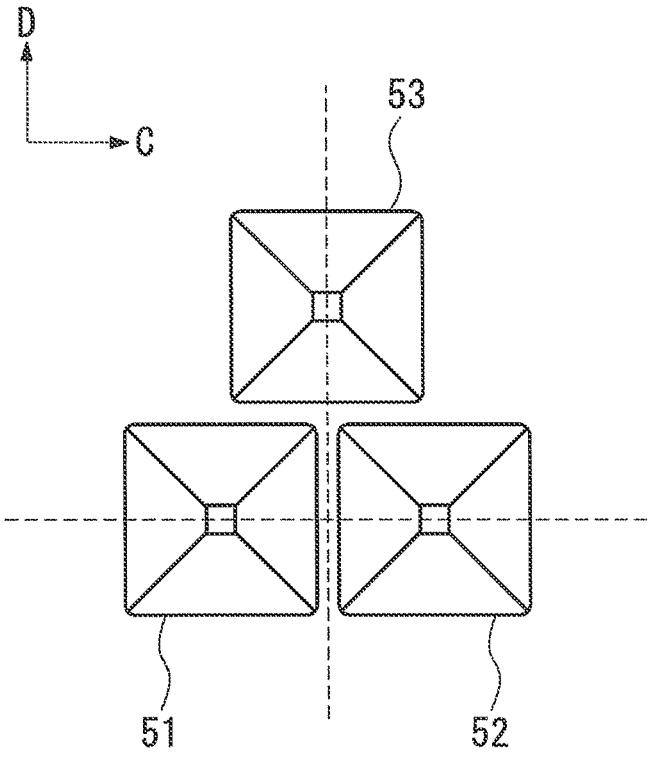
FIG. 2B is a top view schematically showing an arrangement of horn antennas 51 to 53.

Three adjacent horn antennas 51 to 53 are now considered. FIG. 2B is a top view schematically showing the arrangement of the horn antennas 51 to 53. Upon considering the above-mentioned offset in a simplified way, the significance of the offset can be understood as follows. Here, a case where the centers of the horn antennas 51 and 52 are aligned in the direction C will be described. In this case, the horn antenna 53 is separated from the horn antenna 51 in the direction D. It can be understood that the horn antennas 51 and 53 are arranged in such a manner that the centers of the horn antennas 51 and 53 are not aligned in the direction D.

Figure 3A:
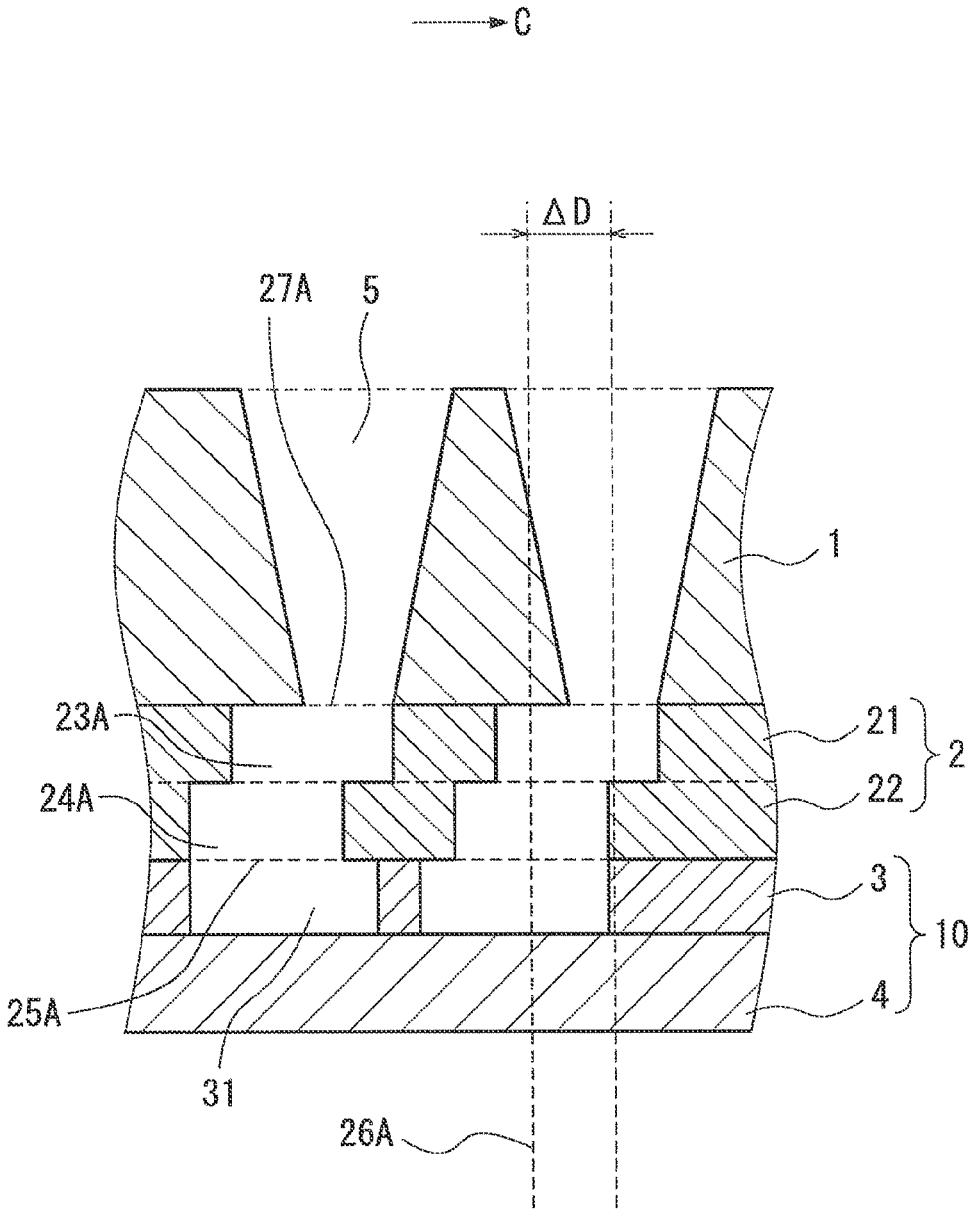
FIG. 3A is an enlarged sectional view schematically showing a configuration of a cross-section of the antenna 100 taken along a line IIIA-IIIA of FIG. 2A.
Figure 3B:
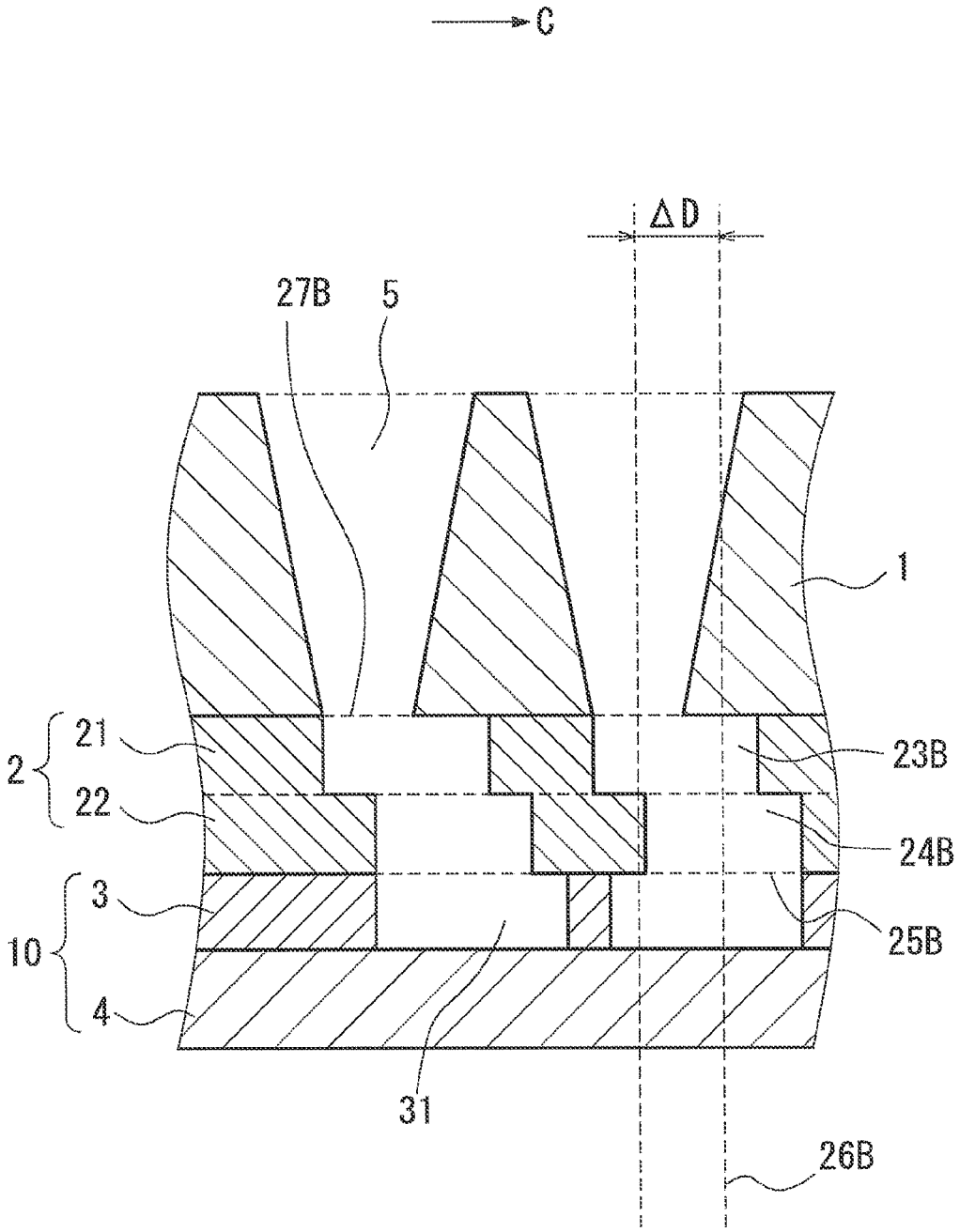
FIG. 3B is an enlarged sectional view schematically showing a configuration of a cross-section of the antenna 100 taken along a line IIIB-IIIB of FIG. 2A.

Next, a configuration of a cross-section of the antenna 100 will be described. FIG. 3A is an enlarged sectional view schematically showing a configuration of a cross-section of the antenna 100 taken along a line IIIA-IIIA of FIG. 2A. FIG. 3B is an enlarged sectional view schematically showing a configuration of a cross-section of the antenna 100 taken along a line IIIB-IIIB of FIG. 2A. The antenna layer 1 is stacked on the coupling layer 2. The coupling layer 2 is stacked on the waveguide layer 3. The waveguide layer 3 is stacked on the bottom layer 4. The antenna layer 1, the coupling layer 2, the waveguide layer 3, and the bottom layer 4 can be stacked by various joining methods, such as screwing and adhesion using an adhesive.

The coupling layer 2 is formed of a coupling-layer upper layer 21 and a coupling-layer lower layer 22. In the coupling-layer upper layer 21, upper waveguides which penetrate the coupling-layer upper layer 21 are formed. At the line IIIA-IIIA, an upper waveguide 23A which extends in the direction C as shown in FIG. 3A is formed in the coupling-layer upper layer 21. A right end of the upper waveguide 23A is coupled to a lower end of the corresponding horn antenna 5 at a connection end 27A (also referred to as a third connection end). At the line IIIB-IIIB, an upper waveguide 23B which extends in the direction C as shown in FIG. 3B is formed in the coupling-layer upper layer 21. A left end of the upper waveguide 23B is coupled to a lower end of the corresponding horn antenna 5 at a connection end 27B (also referred to as a fourth connection end). That is, it can be understood that the upper waveguide 23A at the line IIIA-IIIA is coupled to the corresponding horn antenna 5 in a direction opposite to the upper waveguide 23B at the line IIIB-IIIB.

In the coupling-layer lower layer 22, lower waveguides which penetrate the coupling-layer lower layer 22 are formed. At the line IIIA-IIIA, a lower waveguide 24A which extends in the direction C as shown in FIG. 3A is formed in the coupling-layer lower layer 22. A right end of the lower waveguide 24A is coupled to a left end of the corresponding upper waveguide 23A. At the line IIIB-IIIB, a lower waveguide 24B which extends in the direction C as shown in FIG. 3B is formed in the coupling-layer lower layer 22. A left end of the lower waveguide 24B is coupled to a right end of the upper waveguide 23B.

Each of the upper waveguide 23A and the lower waveguide 24A is also referred to as a second waveguide. Each of the upper waveguide 23B and the lower waveguide 24B is also referred to as a third waveguide.

In the waveguide layer 3, a waveguide 31 (also referred to as a first waveguide) which penetrates the waveguide layer 3 is formed. The waveguide 31 is coupled to a lower end of the lower waveguide 24A and a lower end of the lower waveguide 24B.

Note that a center 26A of a connection end 25A (also referred to as a first connection end), which connects the lower waveguide 24A and the waveguide 31 to each other, and a center 26B of a connection end 25B (also referred to as a second connection end), which connects the lower waveguide 24B and the waveguide 31 to each other, are formed at positions where no offset is provided, unlike the horn antennas 5. Specifically, it can be understood that on the basis of the center 26A of the connection end 25A, at the line IIIA-IIIA, radio waves propagate in the upper right direction from the waveguide 31 to the lower end of the horn antenna 5 through the lower waveguide 24A and the upper waveguide 23A. It can also be understood that on the basis of the center 26B of the connection end 25B, at the line IIIB-IIIB, radio waves propagate in the upper left direction from the waveguide 31 to the lower end of the horn antenna 5 through the lower waveguide 24B and the upper waveguide 23B.

With this configuration, even if the waveguide 31 is formed without consideration of the offset, the distances from the waveguide 31 to the horn antennas 5, which are offset at the line IIIA-IIIA and the line IIIB-IIIB, can be made equal, merely by offsetting the waveguide directions of the upper waveguide and the lower waveguide in opposite directions by the same value ΔD (also referred to as a first value), thereby making it possible to guide radio waves without causing any phase difference.

Figure 4:
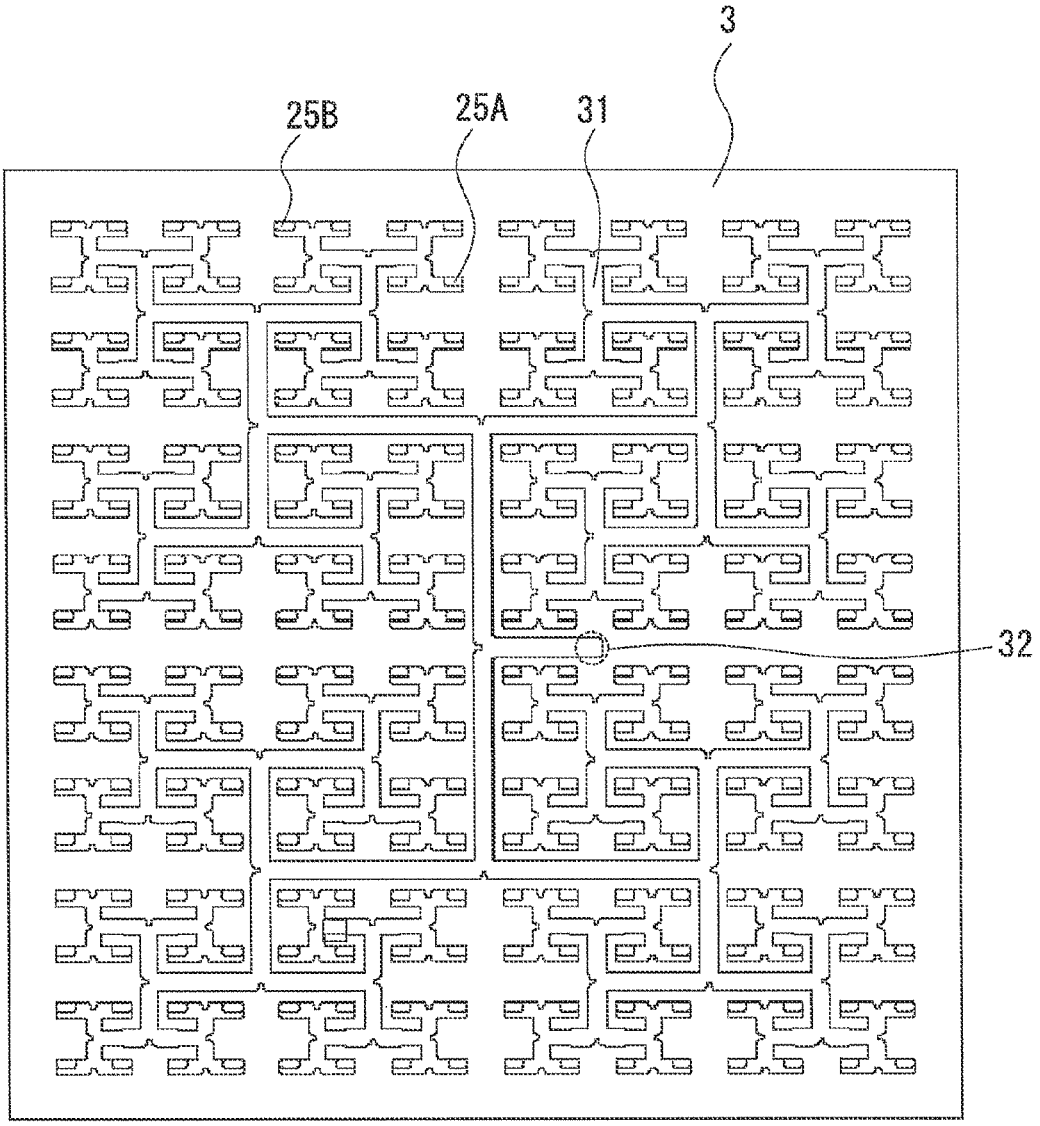
FIG. 4 is a diagram schematically showing a configuration of a waveguide layer 3 and a coupling layer 2 when they are viewed from a bottom layer 4.

Next, the configuration of the waveguide layer 3 will be described. FIG. 4 is a diagram schematically showing the configuration of each of the waveguide layer 3 and the coupling layer 2 when they are viewed from the bottom layer 4. In the bottom layer 4, a waveguide entrance which penetrates the bottom layer 4 is formed (not shown). The waveguide entrance is coupled to the waveguide 31 at a location 32 shown in FIG. 4. Accordingly, radio waves are introduced into the waveguide 31 through the waveguide entrance.

In the waveguide layer 3, the waveguide 31 is formed as a waveguide having branches in such a manner that the distances from a portion coupled to the waveguide entrance (i.e., the location 32 shown in FIG. 4) to the connection end 25A and the connection end 25B are equal to each other. In other words, radio waves propagate from the outside to the connection end 25A and the connection end 25B through the waveguide entrance at the same phase.

Figure 5:
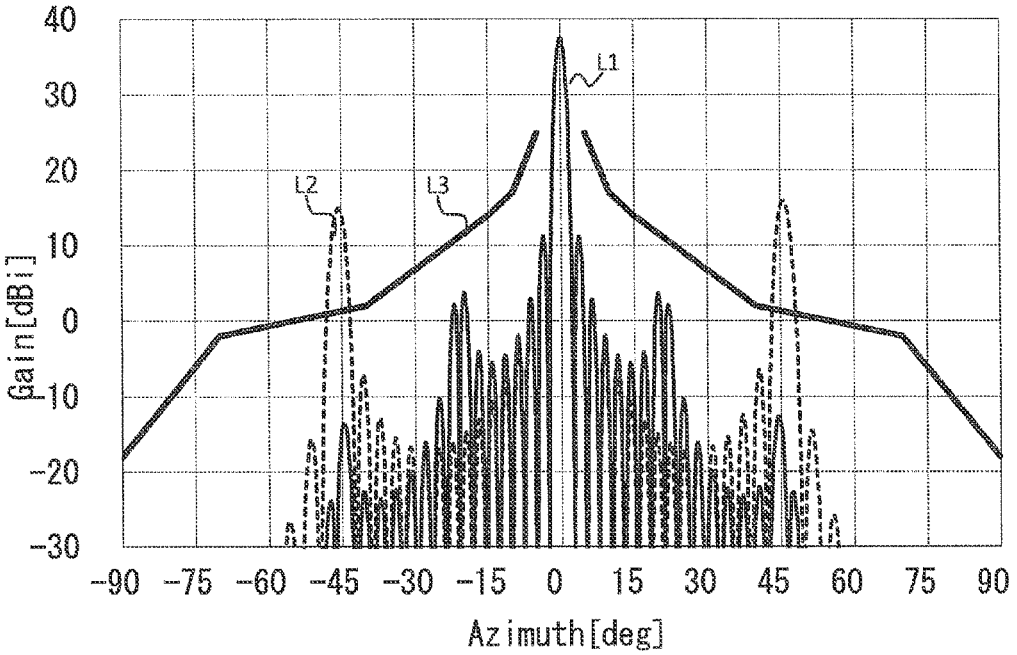
FIG. 5 is a graph showing radio wave radiation characteristics of the antenna 100.

Next, the radio wave radiation characteristics of the antenna 100 will be described. FIG. 5 is a graph showing the radio wave radiation characteristics of the antenna 100. Referring to FIG. 5, the radio wave radiation characteristics of the antenna 100 are indicated by a solid line L1. As comparative examples, the radio wave radiation characteristics of an antenna in which horn antennas are arranged in a square lattice, without providing an offset, as disclosed in Patent Literature 1 are indicated by a dashed line L2, and CLASS 2 standards of the ETSI (European Telecommunications Standards Institute) are indicated by a thick line L3. The horizontal axis represents the azimuth of a surface taken along a line V-V shown in FIG. 2A as an observation surface. Note that the front face of the antenna 100 is represented by 0. The vertical axis represents a gain.

As shown in FIG. 5, it is understood that, in the comparative example (L2), side lobes of a large gain occur, which lobes exceed the CLASS 2 standards of the ETSI (European Telecommunications Standards Institute) (L3). That is, as mentioned above, the side lobes in the comparative example (L2) are not sufficiently suppressed.

On the other hand, in the radio wave radiation characteristics (L1) of the antenna 100, the side lobes are sufficiently suppressed, and thus the radio wave radiation characteristics that satisfy the CLASS 2 standards (L3) of the ETSI (European Telecommunications Standards Institute) can be achieved. That is, it can be understood that the horn antennas 5 are arranged with an offset as in the configuration of the present invention, thereby achieving an antenna having radio wave radiation characteristics in which the side lobes are sufficiently suppressed.

In the above-described comparative example (L2), in order to suppress the side lobes, it is necessary to reduce the opening size of each horn antenna to be smaller than the wavelength of a radiated wave (for example, millimeter wave), and to increase the density of the horn antennas to be arranged. In this case, however, the structures of the horn antennas and the waveguides leading to the horn antennas are miniaturized, which makes it difficult to prepare the antennas and waveguides, resulting in an increase in the cost of the antenna.

On the other hand, in the configuration of the present invention, the side lobes can be suppressed by the arrangement of the horn antennas, which eliminates the need to increase the density of the horn antennas to be arranged. Therefore, in this configuration, the opening size (the length of a side of an opening) of each of the horn antennas 5 can be set to be equal to or more than the wavelength of a radiated wave (for example, millimeter wave). However, considering the convenience of the actual use of the antenna and the ease of preparation of the antenna, the opening size (the length of the side of the opening) of each of the horn antennas 5 is desirably set to be equal to or less than quadruple the wavelength of the radiated wave. However, this is not intended to exclude a case where the opening size (the length of a side of an opening) of each of the horn antennas 5 is set to be equal to or more than quadruple the wavelength of the radiated wave.

Therefore, according to the configuration of the present invention, the structures of the horn antennas and the waveguides leading to the horn antennas can be easily prepared, and thus the antenna can be produced at a low price.

The present invention is not limited to the above exemplary embodiments, and can be modified as appropriate without departing from the scope of the invention. For example, the horn antennas have been described above as being the antenna elements, but this is only an example. For example, other antenna elements such as lens antennas and dielectric rod antennas can also be used. Further, the horn antennas each formed in a quadrangular pyramid shape have been described above, but this is only an example. For example, horn antennas formed into other pyramidal shapes such as a cone shape, an elliptic cone shape, and a hexagonal pyramid shape can also be used, as long as a desired gain can be obtained. Not only the pyramidal shapes, but also a cylindrical shape may be used.

The waveguides (the upper waveguide 23A, the lower waveguide 24A, the upper waveguide 23B, and the lower waveguide 24B) which have a four-stage crank shape and couple the horn antennas 5 to the waveguide layer 3 have been described above, but this is only an example. For example, the waveguides that couple the horn antennas 5 to the waveguide layer 3 may have a crank shape with an arbitrary number of stages other than four, as long as the reflection loss of radio waves is within an allowable range. Alternatively, the waveguides that couple the horn antennas 5 to the waveguide layer 3 may be smooth pipe lines having a shape other than a crank shape, as long as the reflection loss of radio waves is within an allowable range.

The arrangement of the horn antennas 5 has been described above only as an example. Instead of arranging the horn antennas 5 in a strictly staggered manner, for example, the horn antennas 5 may be arranged with an arbitrary offset between a staggered arrangement and a square lattice arrangement. The horn antennas 5 need not necessarily be arranged regularly over the entire surface of the antenna layer 1, and a plurality of regions in which the horn antennas are offset in different ways may be present. In other words, the antenna 100 includes a region in which the horn antennas 5 are arranged with an offset to prevent the horn antennas from being arranged in a square lattice, thereby making it possible to suppress the side lobes.

The antenna layer 1, the coupling-layer upper layer 21, the coupling-layer upper layer 22, and the waveguide layer 3 and the bottom layer 4 (which constitute the feeder circuit layer 10) may be integrally formed, if they can be prepared. For example, in the case of preparing the layers by casting, the coupling-layer upper layer 21 and the coupling-layer lower layer 22 may be formed integrally with the antenna layer 1, or the coupling-layer upper layer 21 may be formed integrally with the antenna layer 1. The coupling-layer upper layer 21 and the coupling-layer lower layer 22 may be formed integrally with the waveguide layer 3, or the coupling-layer lower layer 22 may be formed integrally with the waveguide layer 3.

The antenna layer 1, the coupling layer 2, the waveguide layer 3, and the bottom layer 4 may be formed, not only of a metal, but also of a dielectric material, such as a resin, the surface of which is covered with a conductive material such as a metal. In the case of using a resin, the antenna can be easily prepared by injection molding or the like.

The case where the waveguide entrance is formed in the bottom layer 4 has been described above only as an example. The waveguide entrance may be formed, for example, in the waveguide layer 3.

Although the present invention has been described above with reference to exemplary embodiments, the present invention is not limited to the above exemplary embodiments. The configuration and details of the present invention can be modified in various manners which can be understood by those skilled in the art within the scope of the invention.

This application is based upon and claims the benefit of priority from Japanese patent application No. 2013-8172, filed on Jan. 21, 2013, the disclosure of which is incorporated herein in its entirety by reference.

REFERENCE SIGNS LIST

100 ANTENNA
1 ANTENNA LAYER

2 COUPLING LAYER
3 WAVEGUIDE LAYER
4 BOTTOM LAYER
5, 51-53 HORN ANTENNAS
10 FEEDER CIRCUIT LAYER
21 COUPLING-LAYER UPPER LAYER
22 COUPLING-LAYER LOWER LAYER
23A UPPER WAVEGUIDE
23B UPPER WAVEGUIDE
24A LOWER WAVEGUIDE
24B LOWER WAVEGUIDE
31 WAVEGUIDE
25A CONNECTION END
25B CONNECTION END
26A CENTER OF CONNECTION END 25A
26B CENTER OF CONNECTION END 25B
27A CONNECTION END
27B CONNECTION END

The invention claimed is:

1. An antenna comprising:

a feeder circuit layer in which a waveguide entrance and a first waveguide through which a radio wave is propagated are formed;

an antenna layer in which a plurality of antenna elements are formed; and a coupling layer that is formed between the feeder circuit layer and the antenna layer and couples the first waveguide to the plurality of antenna elements with a waveguide, wherein the plurality of antenna elements include a first antenna element, a second antenna element, and a third antenna element, the second and third antenna elements being adjacent to the first antenna element, the first and second antenna elements are arranged in such a manner that centers of the first and second antenna elements are aligned in a first direction parallel to a principal surface of the antenna layer, the third antenna element is arranged in such a manner that the third antenna element is separated from the first antenna element in a second direction and centers of the first and third antenna elements are not aligned in the second direction, the second direction being parallel to the principal surface of the antenna layer and perpendicular to the first direction, in the coupling layer, a second waveguide that connects the first antenna element and the first waveguide to each other and a third waveguide that connects the third antenna element and the first waveguide to each other are formed, and a distance between a first connection end that connects the first waveguide and the second waveguide to each other and the waveguide entrance formed in the feeder circuit layer is equal to a distance between a second connection end that connects the first waveguide and the third waveguide to each other and the waveguide entrance formed in the feeder circuit layer.

2. The antenna according to claim 1, wherein a center of the first connection end and a center of a third connection end that connects the first antenna element and the second waveguide to each other are separated from each other in the first direction by a first value, and a center of the second connection end and a center of a fourth connection end that connects the third antenna element and the third waveguide to each other are separated from each other in a direction opposite to the first direction by the first value.

3. The antenna according to claim 1, wherein the plurality of antenna elements are formed in a size equal to or greater than a wavelength of a radiated wave.

4. The antenna according to claim 1, wherein the plurality of antenna elements each have a pyramidal shape with a vertex facing the coupling layer.

5. The antenna according to claim 4, wherein the plurality of antenna elements each have a quadrangular pyramid shape with a vertex facing the coupling layer.

6. The antenna according to claim 5, wherein openings of the plurality of antenna elements that are located at a side opposite to the coupling layer have a square shape, and a length of a side of the square shape is equal to or more than a wavelength of a radiated wave.

7. The antenna according to claim 1, wherein the plurality of antenna elements are arranged in a staggered manner.

8. The antenna according to claim 1, wherein the second and third waveguides are formed in a multi-stage crank shape.

* * * * *